US009261861B2

(12) United States Patent
Hasegawa et al.

(10) Patent No.: US 9,261,861 B2
(45) Date of Patent: Feb. 16, 2016

(54) RADIO-CONTROLLED TIMEPIECE

(71) Applicant: CASIO COMPUTER CO., LTD., Shibuya-ku, Tokyo (JP)

(72) Inventors: Kosuke Hasegawa, Fussa (JP); Yuki Oshita, Tokyo (JP); Takeshi Matsue, Kokubunji (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/560,868

(22) Filed: Dec. 4, 2014

(65) Prior Publication Data

US 2015/0185706 A1 Jul. 2, 2015

(30) Foreign Application Priority Data

Dec. 26, 2013 (JP) ..... 2013-268817

(51) Int. Cl.
*G04R 20/04* (2013.01)
*G04R 20/02* (2013.01)

(52) U.S. Cl.
CPC ..... *G04R 20/04* (2013.01); *G04R 20/02* (2013.01)

(58) Field of Classification Search
CPC ..... G04R 20/00; G04R 20/02; G04R 20/04; G04R 20/06; G04R 20/08; G04R 20/14
USPC ..... 368/47
See application file for complete search history.

(56) References Cited

U.S. PATENT DOCUMENTS

2007/0230285 A1* 10/2007 Nakagawa ..... G01S 19/14 368/47
2008/0165628 A1* 7/2008 Urano ..... G04C 9/02 368/47
2009/0129206 A1* 5/2009 Baba ..... G01S 19/34 368/14
2012/0188854 A1* 7/2012 Baba ..... G04R 20/04 368/47
2012/0201101 A1* 8/2012 Akiyama ..... G04R 20/06 368/47
2013/0121399 A1* 5/2013 Eliezer ..... G04G 7/02 375/238
2014/0293756 A1* 10/2014 Akiyama ..... G04R 20/06 368/47

FOREIGN PATENT DOCUMENTS

JP 2008145287 A 6/2008
JP 2009250801 A 10/2009

* cited by examiner

*Primary Examiner* — Amy Cohen Johnson
*Assistant Examiner* — Matthew Powell
(74) *Attorney, Agent, or Firm* — Holtz, Holtz & Volek PC

(57) ABSTRACT

A radio-controlled timepiece includes the following. A timekeeping unit keeps date and time. A satellite radio wave receiving unit receives a transmitting radio wave of a positioning satellite. A receiving term setting unit sets a receiving term with the satellite radio wave receiving unit. A date/time obtaining unit obtains date/time information from the transmitting radio wave received by the satellite radio wave receiving unit. An elapsed time counting unit counts elapsed time from when the date and time is obtained by the date/time obtaining unit. A first judging unit judges whether the elapsed time is less than a first reference time determined based on a timekeeping error of the timekeeping unit and a format of a signal transmitted from the positioning satellite.

6 Claims, 5 Drawing Sheets

RADIO-CONTROLLED TIMEPIECE

BACKGROUND OF THE INVENTION

1. Field of the Invention

The present invention relates to a radio-controlled timepiece.

2. Description of the Related Art

Conventionally, there has been an electronic timepiece (radio-controlled timepiece) which includes functions to receive a radio wave from a positioning satellite composing a global navigation satellite system such as GPS (Global Positioning System) of the United States to obtain time information, and to automatically correct the date and time being counted to display the correct date and time. In addition to GPS, as the global navigation satellite system, GLONASS of Russia and COMPASS of China are in use, and GALILEO of Europe and QZSS (Quasi-Zenith Satellite System) of Japan are being planned and tested. As for civilian use, there are many GPS which have already started operation.

The positioning satellite of the GPS (hereinafter referred to as GPS satellite) separately transmits timekeeping data output based on an atomic clock mounted inside the GPS satellite and correction data showing a difference from the UTC (Coordinated Universal Time) of the timekeeping data due to a leap second. Therefore, the present UTC date and time is obtained by correcting the timekeeping data with the value of the difference.

The value of the difference changes when a new leap second is inserted or deleted. At present, the leap second is executed irregularly by inserting a second after 23 hours 59 minutes 59 seconds or deleting 23 hours 59 minutes 59 seconds on June 30th and/or December 31st in the UTC as necessary. Therefore, the value of the difference needs to be suitably obtained and updated.

However, with the transmitting data of the GPS satellite, the date and time information can be obtained once every 6 seconds, however, the information regarding the leap second is transmitted only once every 12.5 minutes. Therefore, for radio-controlled timepieces, especially, portable timepieces with a small battery load capacity, receiving all pieces of data for 12.5 minutes or continuing reception until information regarding the leap second is obtained leads to a drastic increase in power consumption.

The following is disclosed as the conventional technique. The reception of the radio wave is paused after receiving the date/time information, and estimating the time until reaching the position where the information regarding the leap second is transmitted from the data position where the date/time information is obtained. The radio wave is received after the estimated time (for example, Japanese Patent Application Laid-Open Publication No. 2008-145287, Japanese Patent Application Laid-Open Publication No. 2009-250801). Moreover, it is also disclosed to receive such information regarding the leap second in June or December, and to reduce the receiving time from the GPS satellite in months where the leap second is not inserted.

However, according to the conventional technique, the radio wave needs to be received at least twice in order to obtain the data regarding the leap second from the positioning satellite. In order to reduce the load on the battery of radio-controlled timepieces, especially small or portable ones, there is a demand to suppress receiving time and receiving frequency from the positioning satellite as much as possible. On the other hand, in order to receive the necessary information in a small amount of receiving time, the operation of receiving needs to be performed at a suitable timing.

SUMMARY OF THE INVENTION

The present invention has been conceived in view of the above problems, and one of the main objects is to provide a radio-controlled timepiece which is able to keep the date and time suitably corresponding to the leap second while suppressing increase of power consumption.

According to an aspect of the present invention, there is provided a radio-controlled timepiece including:

a timekeeping unit which keeps date and time;

a satellite radio wave receiving unit which receives a transmitting radio wave of a positioning satellite;

a receiving term setting unit which sets a receiving term with the satellite radio wave receiving unit;

a date/time obtaining unit which obtains date/time information from the transmitting radio wave received by the satellite radio wave receiving unit;

an elapsed time counting unit which counts elapsed time from when the date and time is obtained by the date/time obtaining unit; and a first judging unit which judges whether the elapsed time is less than a first reference time determined based on a timekeeping error of the timekeeping unit and a format of a signal transmitted from the positioning satellite, wherein, (i) the receiving term setting unit sets a receiving term corresponding to transmitting timing of a block including correction information regarding a leap second among blocks of a predetermined length including one piece of the date/time information based on the date and time kept by the timekeeping unit when the first judging unit judges that the elapsed time is less than the first reference time; and (ii) the receiving term setting unit sets the receiving term corresponding to the block including the correction information regarding the leap second based on the obtained date/time information or a position of the format of receiving data regarding the obtained date/time information after setting the receiving term corresponding to the transmitting timing of any of the blocks based on the date and time kept by the timekeeping unit and obtaining the date/time information when the first judging unit judges that the elapsed time is not less than the first reference time.

BRIEF DESCRIPTION OF THE DRAWINGS

The present invention and the above-described objects, features and advantages thereof will become more fully understood from the following detailed description with the accompanying drawings and wherein.

DESCRIPTION OF THE PREFERRED EMBODIMENTS

An embodiment of the present invention is described with reference to the drawings.

Figure 1:
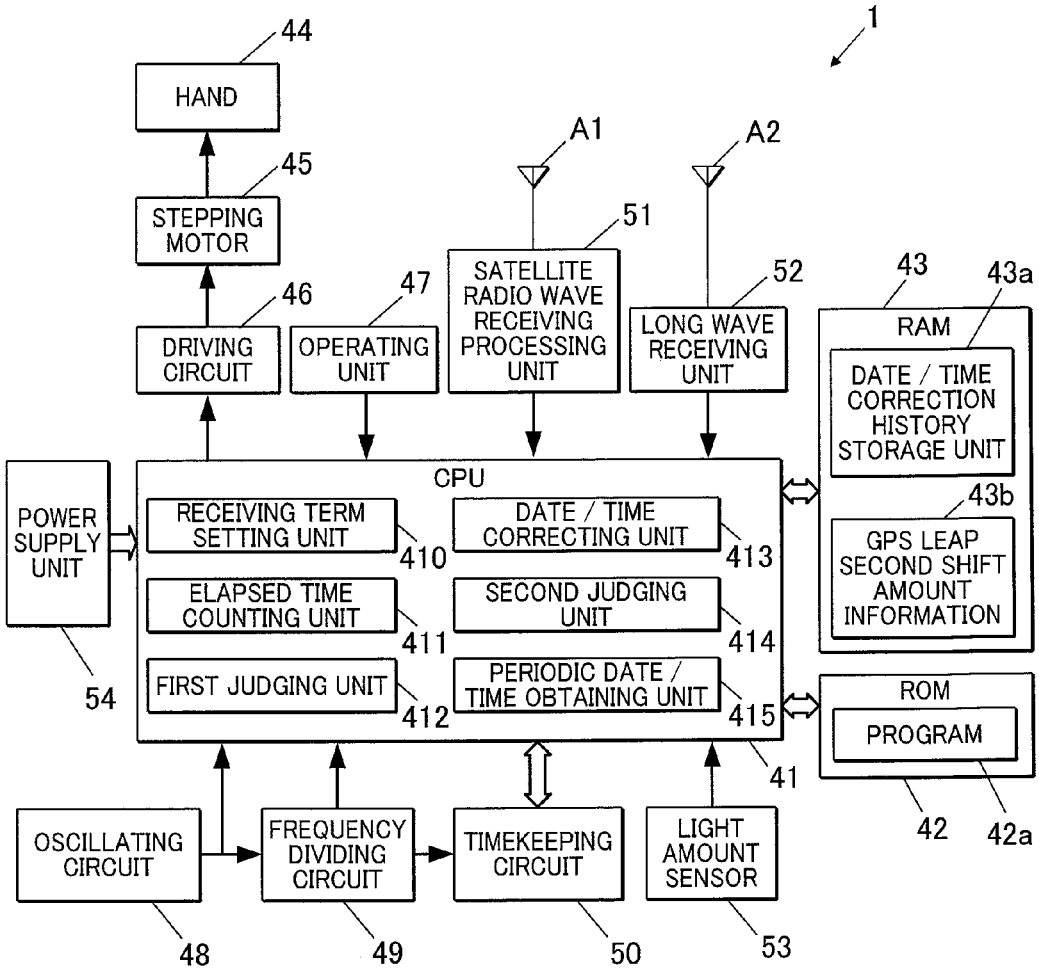
FIG. 1 is a block diagram showing an internal configuration of the radio-controlled timepiece of an embodiment of the present invention.

FIG. 1 is a block diagram showing an internal configuration of a radio-controlled timepiece of the present embodiment.

The radio-controlled timepiece 1 is a portable electronic timepiece which is used with low electric power consumption, and an example of such radio-controlled timepiece 1 includes an electronic watch.

The radio-controlled timepiece 1 includes a CPU (Central Processing Unit) 41 (receiving term setting unit 410, elapsed time counting unit 411, first judging unit 412, date/time correcting unit 413, second judging unit 414, and periodic date/time obtaining unit 415), a ROM (Read Only Memory) 42, a RAM (Random Access Memory) 43, a plurality of hands 44, a stepping motor 45, a driving circuit 46, an operating unit 47, an oscillating circuit 48, a frequency dividing circuit 49, a timekeeping circuit 50 as a timekeeping unit, a satellite radio wave receiving processing unit 51 and antenna A1, a long wave receiving unit 52 and antenna A2, a light amount sensor 53, and a power supply unit 54. The receiving term setting unit 410, the elapsed time counting unit 411, the first judging unit 412, the date/time correcting unit 413, the second judging unit 414, and the periodic date/time obtaining unit 415 can each be a different CPU 41.

The CPU 41 performs various calculating processing and centrally controls the entire operation of the radio-controlled timepiece 1. Moreover, the CPU 41 transmits a signal to the timekeeping circuit 50 based on the date/time data obtained from the satellite radio wave receiving processing unit 51 and the date/time data obtained by decoding the signal input from the long wave receiving unit 52. Then, the CPU 41 corrects the date/time data held by the timekeeping circuit 50.

The ROM 42 stores various programs for various operation performed by the radio-controlled timepiece 1 and default setting data. The program stored in the ROM 42 includes a program 42*a* regarding the correction of the leap second of the time counted by the timekeeping circuit 50. The operation of the program 42*a* regarding the leap second correction is not limited to correction of the leap second as the main object based on operation setting time stored in the RAM 43 or input from the operating unit 47 and can be performed together with normal date/time correction operation or obtaining operation of the date and time or position by the user.

The RAM 43 provides a memory space for a job in the CPU 41 and stores various pieces of temporary data and rewritable setting data. The RAM 43 includes a date/time correction history storage unit 43*a* (date/time obtaining history storage unit) and GPS leap second shift amount information 43*b*.

The date/time correction history storage unit 43*a* stores the date and time of the previous occasion that the transmitting radio wave from the positioning satellite or the time radio wave (standard radio wave) in the long waveband was received and time correction was performed. Moreover, the date/time correction history storage unit 43*a* also stores the receiving OK flag (obtaining success/failure information) showing whether correction of the date and time performed by receiving the radio wave is necessary at present. Here, the receiving OK flag is binary data shown with 1 bit. When the flag is on (for example, set to "1"), this shows that the present date/time data is obtained by receiving the radio wave recently within a predetermined amount of time (predetermined interval), here for example, within 24 hours.

The GPS leap second shift amount information 43*b* stores the date and time that the leap second shift amount information showing the difference between the transmitting time of the GPS satellite and the UTC time is obtained. Moreover, the GPS leap second shift amount information 43*b* also stores the leap second obtaining flag showing whether the latest information regarding the leap second shift amount in the GPS satellite of the past half a year (for example, December to May, June to November) that the present date and time belongs to. Here, the leap second obtaining flag is binary data shown with 1 bit.

Here, the hands 44 are hands used in displaying the time including the hour hand, the minute hand, and the second hand, and the hands 44 are provided rotatable on a dial face. The stepping motor 45 rotates the hands 44 through a train wheel mechanism of a gear train. The rotor is rotated a predetermined angle, for example 180 degrees according to the input of the driving voltage pulse from the driving circuit 46. The driving circuit 46 outputs a driving voltage pulse with a predetermined voltage and a predetermined pulse width to the stepping motor 45 based on the control signal from the CPU 41 to drive the stepping motor 45.

The operating unit 47 includes a plurality of keys and press button switches, and when the keys and press button switches are operated, the content of operation is converted to an electric signal to be output to the CPU 41 as an input signal. Moreover, the operating unit 47 can include a winding crown or a touch sensor.

The oscillating circuit 48 outputs an oscillating signal of a predetermined frequency, for example, 32 kHz. The oscillating circuit 48 is not limited and includes, for example, a crystal oscillator which is small, low in cost, low in power consumption, and does not include a temperature compensation circuit.

The frequency dividing circuit 49 divides the oscillating signal, generates the necessary frequency signal, and outputs the frequency signal. The frequency dividing circuit 49 is able to suitably switch a frequency division ratio to output a signal with a different frequency according to the control signal from the CPU 41.

The timekeeping circuit 50 counts the predetermined frequency signal input from the frequency dividing circuit 49 and the present date and time are kept by adding the above to the date and time of the default setting. The date and time (default value setting date/time) kept by the timekeeping circuit 50 is rewritten and corrected based on the data obtained from the GPS satellite and the standard radio wave with the signal from the CPU 41.

The satellite radio wave receiving processing unit 51 is a module which uses the antenna A1 which can receive transmitting radio waves in a L1 band (1.57542 GHz in a GPS satellite) to receive the transmitting radio wave from the GPS satellite (positioning satellite), and which demodulates and decodes a navigation message to output date/time information and position information. The satellite radio wave receiving processing unit 51 stores the leap second shift amount data, and when the GPS time data is obtained, the present date/time is calculated and output with the shift amount added. Moreover, when the date/time information is obtained from one GPS satellite, the satellite radio wave receiving processing unit 51 estimates the delay amount corresponding to the delay due to propagating time from the GPS satellite to the receiving location and makes a suitable correction so that the influence of delay is reduced. Then, the date/time information is output.

According to the control signal from the CPU 41, the satellite radio wave receiving processing unit 51 turns on the power supply and operates only in receiving. Therefore, the data regarding the influence such as the leap second shift amount can be stored in the nonvolatile memory included in the satellite radio wave receiving processing unit 51 or stored separately in the RAM 43, and the CPU 41 can input the data in the satellite radio wave receiving processing unit 51 when the data is to be used.

The satellite radio wave receiving processing unit 51 and the antenna A1 compose the satellite radio wave receiving unit. Moreover, the satellite radio wave receiving processing unit 51 and the CPU 41 compose the date/time obtaining unit.

The long wave receiving unit 52 demodulates the time code signal from the standard radio wave received using the antenna A2 which receives a radio wave in the long wave band. The standard radio wave is an amplitude modulating wave (AM wave) in the long wave band. Although not limited, for example, the long wave receiving unit 52 of the present embodiment demodulates with the superheterodyne method. The long wave receiving unit 52 turns on the power supply only when the standard radio wave is received according to a control signal from the CPU 41. The tuning frequency by the antenna A2 can be changed by adjusting the setting of the tuning circuit which is not shown in the long wave receiving unit 52.

The CPU 41, the long wave receiving unit 52 and the antenna A2 compose the external date/time information obtaining unit.

For example, the light amount sensor 53 is provided on the dial provided in the bottom portion of the face where the hands 44 rotate or is provided exposed from a hole provided in the dial. The light amount sensor 53 detects the light amount which enters from the outside. For example, a photodiode is used as the light amount sensor 53. The light amount sensor 53 outputs an electric signal (voltage signal or current signal) according to the light amount, the signal is sampled digitally in the ADC (analog/digital converter) (not shown), and the signal is input to the CPU 41.

The power supply unit 54 supplies the electric power necessary to operate each unit of the radio-controlled timepiece 1. For example, the power supply unit includes a button type primary battery and the battery is provided to be removable and exchangeable. Preferably, the battery is small and lightweight and can be used stably and continuously for a long period of time consuming a small amount of power. Therefore, preferably, the operation of the satellite radio wave receiving processing unit 51 which consumes a drastically large amount of electric power in the radio-controlled timepiece 1 is performed within a short period of time, and sufficient intervals are open between the operations.

Next, the navigation message received from the GPS satellite is described.

Figure 2:
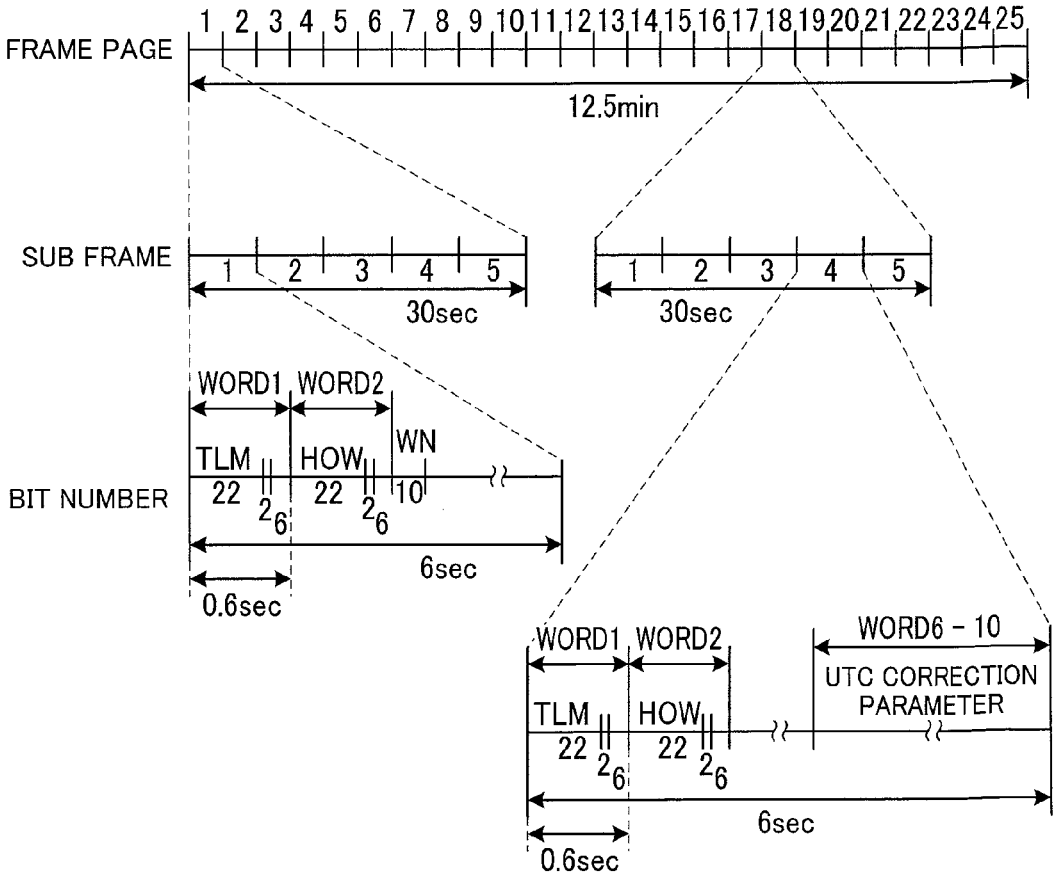
FIG. 2 is a diagram describing a format of a navigation message transmitted by the GPS satellite.

FIG. 2 is a diagram which describes the format of the navigation message transmitted by the GPS satellite.

The navigation message transmitted from the GPS satellite includes a total of 25 pages of frame data and the transmitting time of each page (frame) is 30 seconds. Each page includes 5 pieces of sub-frame data (6 seconds, 1500 bits each), and one piece of sub-frame data further includes 10 WORD (0.6 seconds, 300 bits each). Therefore, the navigation message is transmitted in an interval of 12.5 minutes.

WORD1 of all sub-frame data include TLM (telemetry word) and a lead position of the sub-frame is identified by the fixed code string (Preamble) included in the top of the TLM. WORD2 includes HOW (handover word) and a sub-frame ID. The present date and time is obtained by the elapsed time within the week decoded from HOW. Which sub-frame in the page the read data is is obtained from the sub-frame ID.

In other words, by identifying the Preamble of the first sub-frame and the Preamble of the next sub-frame, the HOW between the above is more surely identified, and the date/time information is obtained. Therefore, in the radio-controlled timepiece 1, normally, the date/time data can be obtained by receiving data for a total of about 10 seconds, the data including the data of one sub-frame, one WORD of the next sub-frame, and data of half of the interval of the sub-frame as the difference of receiving timing.

In all of the pages, WORD3 of the data of the sub-frame 1 includes WN (week number). The WN shows the number of the week starting from Jan. 6, 1980 counted periodically in 10 bits. In other words, with the combination of WN and HOW, an almost complete date/time information is obtained. When there is a possibility of difference of a week or more in the date and time, the WN needs to be received in addition to the HOW to identify the date and time.

In sub-frame 4 and 5, the almanac data regarding the predicted orbit of all of the satellites are sequentially transmitted divided to each page, and the page number can be identified by the ID of the satellite.

A UTC correction parameter (correction information regarding the leap second) is included in the sub-frame 4 of page 18 from WORD6 to WORD10. As described above, the GPS satellite calculates the date and time starting from Jan. 6, 1980. This date and time (GPS date and time) does not include the leap second, and therefore, there is a difference between the UTC (Coordinated Universal Time) date and time in the amount of the integrated value of the leap second executed from Jan. 6, 1980 and thereafter. The UTC correction parameter includes the present leap second integrated value $\Delta t_{LS}$, scheduled week number $WN_{LSF}$ and day number DN when the schedule of the next leap second to be executed is determined, and a planned value $\Delta t_{LSF}$ of the amount of the integrated value after the leap second is executed. Therefore, the satellite radio wave receiving processing unit 51 corrects the calculated GPS date and time in the amount of the integrated value $\Delta t_{LS}$ and outputs the value as the present UTC date and time. Once the UTC correction parameter is obtained, the parameter can be continuously used until the next leap second is executed.

Next, the date/time information transmitted with the standard radio wave is described.

As the standard radio wave, there are mainly, JJY (registered trademark) of Japan, WWVB of the United states, MSF of the United Kingdom, DCF77 of Germany and the like. A signal (time code) showing the date and time of each minute is transmitted in a one minute interval from the transmitting station. In the radio-controlled timepiece 1, the radio wave from the above transmitting station is received, and the radio wave is decoded and deciphered based on the format of the time code for each transmitting station. With this, the accurate date and time can be obtained.

The insert and delete of the leap second are reflected in the date and time transmitted in the standard radio wave, and the accurate date and time can always be obtained regardless of the insert or delete of the leap second. Moreover, JJY is transmitted including information of the preliminary notice with information showing whether the leap second will be inserted or deleted from one month before the leap second is inserted or deleted. Preliminary notice information showing that the leap second will be executed is transmitted from one month before the insert or delete of the leap second is performed in the WWVB and one hour before in the DCF 77.

When the radio-controlled timepiece 1 of the present embodiment obtains in advance preliminary notice information of the leap second by receiving the transmitting radio wave from the GPS satellite or the standard radio wave, the CPU 41 can correct the difference of the date and time kept by the timekeeping circuit 50 due to the leap second, and output and display the date and time from the timing that the insert or delete of the leap second is performed until the new date/time information is obtained from the GPS satellite or the standard radio wave.

As described above, in order to obtain the accurate date and time based on the transmitting radio wave from the GPS satellite, the correction value $\Delta t_{LS}$ is necessary. Therefore, at least when the leap second is executed, the radio-controlled timepiece 1 needs to receive the new UTC correction parameter and the integrated value $\Delta t_{LS}$ needs to be updated based on the planned value $\Delta t_{LSF}$ before the leap second is executed or the newly obtained integrated value $\Delta t_{LS}$ after the leap second is executed.

Next, the obtaining operation of the leap second information in the radio-controlled timepiece 1 of the present embodiment is described.

As described above, in order to reduce the electric power consumption, when the radio wave is received from the GPS satellite, the receiving term is determined to be about 10 seconds for about 1 sub-frame which is necessary to obtain the date/time information, and the radio-controlled timepiece 1 operates the satellite radio wave receiving processing unit 50 only during the receiving term.

As described above, the navigation message is transmitted in an interval of 12.5 minutes. Therefore, when the sub-frame data including the UTC correction parameter is received, it is necessary to avoid receiving data of a different sub-frame based on wrong date/time data. Therefore, in the radio-controlled timepiece 1, when the timekeeping circuit 50 is keeping the accurate date and time, the transmitting timing of the latest UTC correction parameter is calculated on the basis of past date and time that the UTC correction parameter was received, the ID of the satellite obtained when the sub-frames 4, 5 are received, and the like. Here, when the predicted difference in the date and time kept by the timekeeping circuit 50 is less than a predetermined amount of time, for example, 3 seconds which is half of one sub-frame length, the transmitting timing of the UTC correction parameter is calculated according to the above standard based on the date and time kept by the timekeeping circuit 50. The satellite radio wave receiving processing unit 51 is operated at this timing and the information regarding the leap second is obtained. When it is predicted that the difference of the date and time kept by the timekeeping circuit 50 is to be a predetermined amount of time or more, first the HOW is received to correct the date and time kept by the timekeeping circuit 50, and then the transmitting timing of the UTC correction parameter is calculated according to the above standard based on the corrected date and time.

Here, when a value of a timekeeping error showing a percentage that the time kept by the timekeeping circuit 50 differs from the accurate time and reference difference time for preventing receiving data of a different sub-frame are set in advance, which one of the predicted difference time and the above reference difference time is larger is determined by the elapsed time from the previous obtaining timing of the date/time information. In other words, if the elapsed time where the predicted difference time and the reference difference time becomes equal is the reference time (first reference time), when the timekeeping error is 0.5 seconds/day, and the reference difference time is 3 seconds, the reference time is 6 days. Therefore, if the elapsed time is less than 6 days, the receiving timing of the UTC correction parameter is determined based on the date and time kept by the timekeeping circuit 50 as is, and when the elapsed time is 6 days or more, first a piece of sub-frame data is obtained to correct the date and time kept by the timekeeping circuit 50, and then the receiving timing of the UTC correction parameter is determined.

The elapsed time is obtained by calculating the difference between the obtaining timing of the previous date/time information and the present date/time when the elapsed time is used. Alternatively, the counter can be operated to count from the previous date/time information obtaining timing until the first reference time passes.

Figure 3:
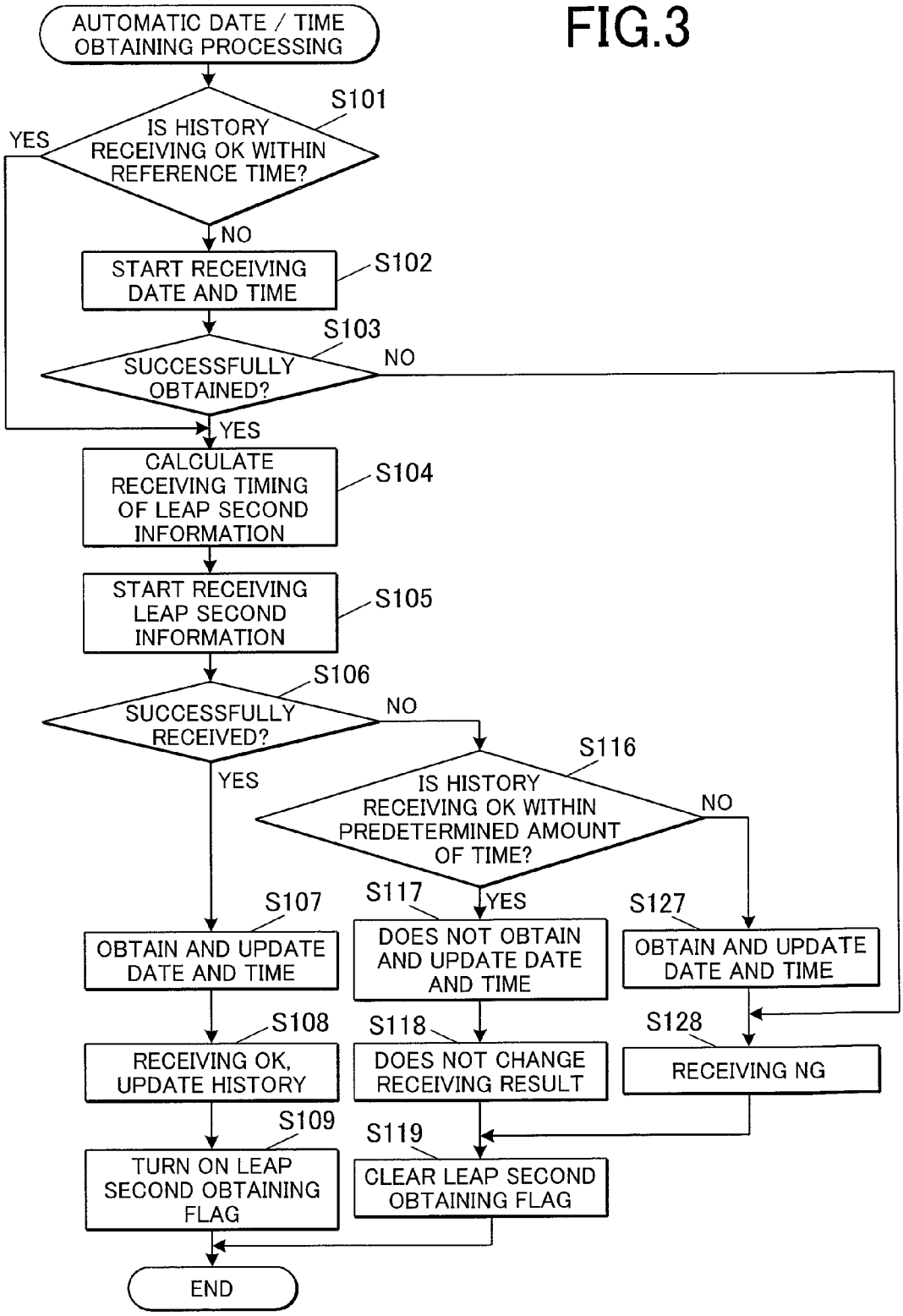
FIG. 3 is a flowchart showing control process of automatic date/time obtaining processing.

FIG. 3 is a flowchart showing a control process performed by the CPU 41 in the automatic date/time obtaining processing performed in the radio-controlled timepiece 1.

The automatic date/time obtaining processing is started at a timing a predetermined condition is satisfied within one time every day when it is confirmed that the leap second obtaining flag is off, in other words, it is confirmed that the leap second will not be executed on or after June 1st or December 1st which is when the leap second is usually notified in advance, or until the UTC correction parameter is newly obtained.

Here, a light amount of a level corresponding to outside sunlight being detected by the light amount sensor 53 is to be the predetermined condition.

When the automatic date/time obtaining processing starts, the CPU 41 refers to the date/time correction history storage unit 43*a* and judges whether the latest receiving of the radio wave regarding the date/time correction succeeded within a reference time (here, within 6 days) from the present (step S101). When it is judged that the above succeeded (step S101, "YES"), the processing of the CPU 41 advances to step S104.

When it is judged that the above did not succeed (step S101, "NO"), the CPU 41 operates the satellite radio wave receiving processing unit 51 and starts the receiving of the radio wave to obtain the date/time information (step S102). Here, for example, the satellite radio wave receiving processing unit 51 is able to receive the radio wave for one sub-frame in about 6 seconds to obtain HOW, and is able to compare the above with the present date information so as to be able to obtain the accurate date/time information. The CPU 41 judges whether the date/time information is successfully obtained (step S103), and when it is judged that the above succeeded (step S103, "YES"), the CPU 41 advances the processing to step S104. When it is judged that the above did not succeed (step S103, "NO"), the CPU 41 advances the processing to step S128.

When the processing advances to step S104, the CPU 41 calculates the latest receiving timing of the sub-frame including the UTC correction parameter based on the obtained date/time information (step S104). After waiting for the transmitting timing, the CPU 41 operates the satellite radio wave receiving processing unit 51 and starts receiving the sub-frame including the UTC correction parameter regarding the leap second information (step S105).

The CPU 41 judges whether the receiving of the UTC correction parameter succeeded (step S106). When it is judged that the receiving succeeded (step S106, "YES"), the CPU 41 calculates the present date and time based on the obtained date/time information and the leap second shift amount regarding the UTC correction parameter, and corrects the date and time of the timekeeping circuit 50 (step S107). The CPU 41 updates the date/time correction history storage unit 43*a* (step S108), and turns on (sets) the leap second obtaining flag of the GPS leap second shift amount information 43*b* (step S109). Then, the CPU 41 ends the automatic date/time obtaining processing.

In the judging processing of step S106, when it is judged that the receiving of the UTC correction parameter did not succeed (step S106, "NO"), next, the CPU 41 refers to the date/time correction history storage unit 43*a*, and judges whether the latest receiving of the radio wave regarding the date/time correction succeeded within a predetermined amount of time (second reference time) from the present (step S116). Here, the predetermined amount of time is time until it is predicted that the difference of the date/time kept by the timekeeping circuit 50 becomes 1 or more seconds, and for example, when the timekeeping error is 0.5 seconds/day, the predetermined amount of time is 2 days. When it is judged that the above succeeded (step S116, "YES"), the CPU 41 releases the previously obtained date/time data and does not update the date/time data of the timekeeping circuit 50 (step S117). Moreover, the CPU 41 does not update the history information of the date/time correction history storage unit 43*a* and it is considered that the operation regarding receiving was not performed (step S118). The CPU 41 clears (turns off) the leap second obtaining flag of the GPS leap second shift amount information 43*b* (step S119), and the automatic date/time obtaining processing ends.

In the judging processing of step S116, when it is judged that the receiving of the ultrasound regarding the date/time correction did not succeed within the predetermined amount of time (step S116, "NO"), the CPU 41 updates the present date/time of the timekeeping circuit 50 with the date and time based on the date/time information obtained in advance and the present value of the leap second shift amount not updated yet (step S127). The CPU 41 turns off the receiving OK flag of the date/time correction history storage unit 43*a* (step S128) to show that the receiving is the "NG" state. Then, the CPU 41 advances the processing to step S119, and after the CPU 41 clears the leap second obtaining flag, the automatic date/time obtaining processing ends.

According to the radio-controlled timepiece 1 of the present embodiment, the date and time are obtained automatically in a different occasion by receiving the standard radio wave. For example, at night from 1 AM to 5 AM, the processing is repeated each hour until the date and time are successfully obtained, in other words, until the receiving OK flag is set to OK. Therefore, the success history of receiving the radio wave in the determining processing of steps S101 and S116 include obtaining the date and time with the standard radio wave.

Moreover, in the automatic date/time obtaining processing, when the UTC correction parameter is received in the processing of steps S105 and S106, the HOW data in the same sub-frame is also received. Therefore, even when the processing is performed within 6 days from the previous receiving of the radio wave (date/time correction) (including when the receiving OK flag is set), and the processing of steps S102 and S103 is not performed, the date/time data is updated in the processing of step S107. In other words, the date/time information can be obtained shortening the receiving time regarding the processing of steps S102 and S103.

When the receiving OK flag is set to OK, the updating of the date and time performed again (processing of steps S107 and S108) based on the date/time data obtained here can be omitted, and only the leap second information can be obtained.

Figure 4:
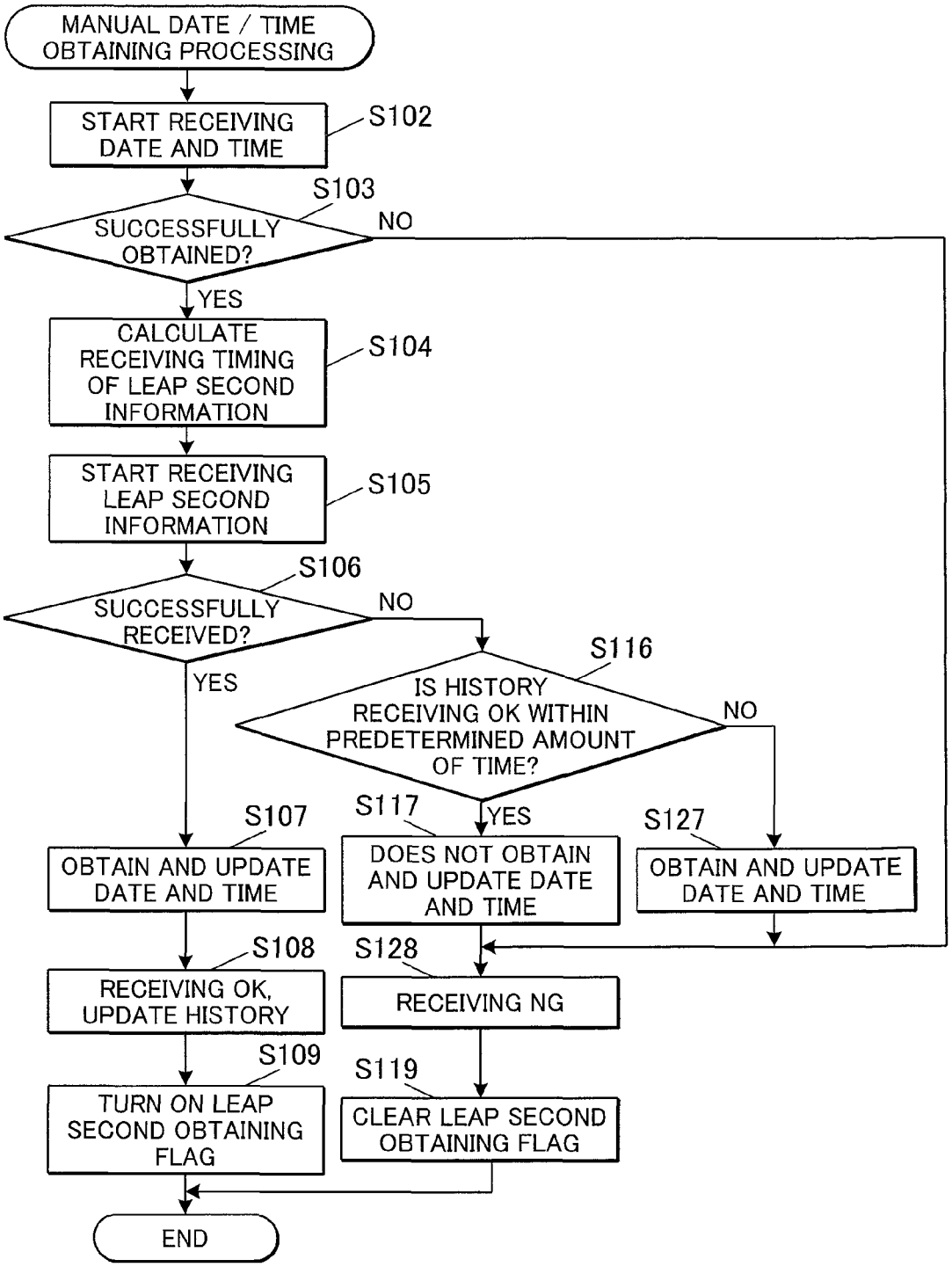
FIG. 4 is a flowchart showing control process of manual date/time obtaining processing.

FIG. 4 is a flowchart showing the control process by the CPU 41 of the manual date/time obtaining processing performed in the radio-controlled timepiece 1.

The manual date/time obtaining processing is started when the user inputs on the operating unit 47 the instruction to perform the processing and the CPU 41 detects the input in a situation where the leap second obtaining flag is off.

The manual date/time obtaining processing is the same as the automatic date/time obtaining processing except the processing of steps S101 and S118 in the automatic date/time obtaining processing is excluded and the order of control is changed. Therefore, the same reference numerals are applied to the same processing, and the detailed description is omitted.

When the manual date/time obtaining processing is started, the CPU 41 starts the date/time receiving (step S102).

In the judging processing of step S116, when it is judged that the radio-wave receiving regarding the date/time correction succeeded within the predetermined term (step S116, "YES"), the CPU 41 does not update the date/time data in the timekeeping circuit 50 (step S117), and the receiving OK flag is turned off and the receiving history is set to NG (step S128). Then, the processing of the CPU 41 advances to step S119.

In other words, in the manual date/time obtaining processing, the date/time information is obtained regardless of the receiving OK flag. Therefore, when the date/time information is successfully obtained, an attempt is to be made to obtain the UTC correction parameter based on the obtained date and time.

Figure 5:
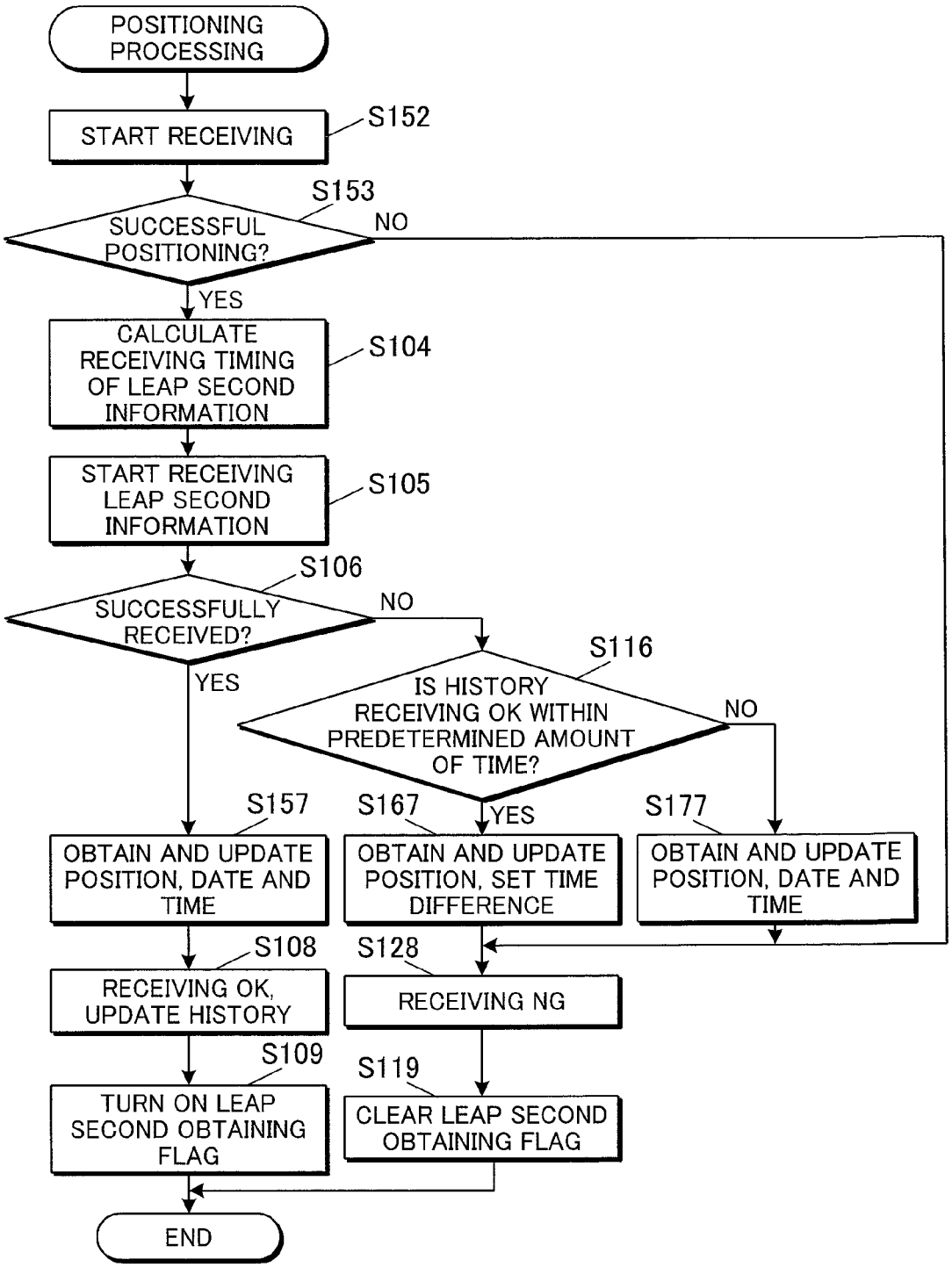
FIG. 5 is a flowchart showing control process of positioning processing.

FIG. 5 is a flowchart showing the control process by the CPU 41 in the positioning processing performed by the radio-controlled timepiece 1.

The positioning processing is started when the user performs input on the operating unit 47 to instruct the start of the processing and the CPU 41 detects the input in a situation where the leap second obtaining flag is off.

The positioning processing is the same as the manual date/time obtaining processing with the exception of the processing of steps S102, S103, S107, S117, and S127 being changed to the processing of steps S152, S153, S157, S167, and S177, respectively. The same reference numerals are applied to the same processing and the detailed description is omitted.

First, the CPU 41 starts the receiving of the radio wave from the GPS satellite with the satellite radio wave receiving processing unit 51 (step S152). In this case, the receiving time is the time necessary to obtain the various pieces of position information and difference in propagating time (pseudo distance) from the plurality of GPS satellites necessary for positioning.

The CPU 41 judges whether the positioning succeeded (step S153), and when it is judged that the above succeeded (step S153, "YES"), the CPU 41 advances the processing to step S104. When it is judged that the above did not succeed (step S153, "NO"), the CPU 41 advances the processing to step S128.

In the judging processing of step S106, when it is judged that the receiving of the leap second information succeeded (step S106, "YES"), the CPU 41 updates the data using the obtained position information and the time information (step S157). Then, the processing of the CPU 41 advances to step S108.

In the judging processing of step S116, when it is judged that the receiving OK flag is set (step S116, "YES"), the CPU 41 obtains and updates the position information and sets the time difference according to the present time zone. On the other hand, the CPU 41 does not use the information regarding the date and time and deletes this data (step S167). Then, the CPU 41 advances the processing to step S128. When it is judged that the receiving OK flag is not set (step S116, "NO"), after the position information and the date/time information are obtained and updated (step S117), the CPU 41 advances the processing to step S128.

As described above, the radio-controlled timepiece 1 of the present embodiment includes a timekeeping circuit 50, a satellite radio wave receiving processing unit 51 which receives the transmitting radio wave of the positioning satellite (GPS satellite) and the antenna A1. The CPU 41 functions as the receiving term setting unit 410 to set the receiving term of the satellite radio wave receiving processing unit 51, and functions as the date/time obtaining unit to obtain the date/time information from the transmitting radio wave received by the satellite radio wave receiving processing unit 51. The CPU 41 functions as the elapsed time counting unit 411 to count the elapsed time from when the date and time are obtained, and functions as the first judging unit 412 to judge whether the elapsed time is less than the first reference time (6 days when the timekeeping error is 0.5 seconds/day) where the difference of the predicted time due to the timekeeping error of the timekeeping circuit 50 becomes equal to or longer than the format of the signal transmitted by the GPS satellite, here, half of the length of the sub-frame.

Then, when it is judged that the elapsed time is less than the first reference time, the receiving term corresponding to the transmitting timing of the sub-frame including the UTC correction parameter is set based on the date/time kept by the timekeeping circuit 50. When it is judged that the elapsed time is not less than the first reference time, after the receiving term corresponding to the transmitting timing of any of the sub-frame is set and the date/time information is obtained based on the date/time kept by the timekeeping circuit 50, the receiving term corresponding to the sub-frame including the UTC correction parameter is set based on the obtained date/time information or the position in the navigation message of the receiving data regarding the obtained date/time information.

In other words, when the time in the timekeeping circuit 50 is basically correct, the satellite radio wave receiving processing unit 51 is operated directly matching with the transmitting timing of the sub-frame including the UTC correction parameter. Therefore, the data regarding the correction of the date/time information obtained from the transmitting radio wave of the GPS satellite can be obtained while reducing the operating time of the satellite radio wave receiving processing unit 51. Therefore, the suitable date and time can be displayed after the timing that the leap second is inserted or deleted, while suppressing the increase of the electric power consumption.

The date/time information can be obtained by receiving the standard radio wave, and by using both the correction of the date and time with the date/time information obtained from the GPS satellite and the correction of the date and time with the date/time information, the electric power consumption can be reduced greatly in the range that the date and time can be obtained by the standard radio wave. On the other hand, when the user is in an environment where it is difficult to receive the standard radio wave such as nighttime and the date/time information is obtained based on the radio wave from the GPS satellite during the day, it is possible to rapidly obtain the necessary information while suppressing the operation time of the satellite radio wave receiving processing unit 51 regarding the receiving of the leap second information to a minimum.

Specifically, by obtaining the date/time information in advance by receiving the standard radio wave, the transmitting timing of the sub-frame including the UTC correction parameter can be directly calculated based on the date/time information and the satellite radio wave receiving processing unit 51 can be operated. Therefore, it is possible to obtain data for correcting the date/time information of the GPS timepiece with a small amount of electric power consumption.

Moreover, the date and time kept by the timekeeping circuit 50 can be corrected based on the date/time information obtained through the satellite radio wave receiving processing unit 51 and the long wave receiving unit 52. Here, the difference due to executing the leap second is 1 second. Therefore, when the date/time information is obtained from the GPS satellite in a situation where the information regarding the leap second is not obtained, it is judged whether the elapsed time from the previous occasion when the date/time information is obtained and the date and time of the timekeeping circuit 50 is corrected is less than a predetermined amount of time where the difference is predicted to become larger than 1 second based on the timekeeping error of the timekeeping circuit 50 (second reference time), for example 2 days when the timekeeping error is 0.5 seconds/day. When the elapsed time is less than the second reference time, the correction of the date and time is not performed and when the elapsed time is not less than the second reference time, the date and time are corrected. With this, a difference of about 1 second which is within the range that the present difference is not enlarged is accepted while a large difference is corrected. Therefore, the timekeeping circuit 50 is able to keep almost precise date and time.

Moreover, when the date/time information obtained periodically once a day fails, the processing to obtain the date/time information is performed a plurality of times throughout the day until the information is successfully obtained. For example, in the radio-controlled timepiece 1, the correction of the date and time by the standard radio wave is performed every hour at nighttime from 1 AM to 5 AM. If all of the above attempts do not succeed, the date/time correction by receiving the radio wave of the GPS satellite is further performed during the day. Whether such processing of periodically obtaining the date/time information succeeds is managed using the receiving OK flag.

In such processing of periodically obtaining the date/time information, when the date/time information is obtained but the receiving of the UTC correction parameter fails, even if the elapsed time from the previous obtaining of the date/time information has not exceeded the above described second reference time, in other words, the difference of the date and time of the timekeeping circuit 50 is predicted to be less than 1 second and the date and time of the timekeeping circuit 50 is not corrected, the receiving OK flag is not updated. Alternatively, when the elapsed time is not less than the second reference time, in other words, the difference of the date and time of the timekeeping circuit 50 is predicted to be 1 second or more and the date and time of the timekeeping circuit 50 is corrected, the receiving OK flag is updated and the history is changed showing the processing of receiving did not succeed.

Therefore, when the difference is a small difference of less than 1 second, the periodic operation of obtaining the date/time information is not repeated to prevent increase in the electric power consumption. When the difference is about 1 second, the periodic operation of obtaining the date/time information is performed so that it is possible to obtain the accurate date and time. Specifically, when the date/time information where there may be a difference of about 1 second is obtained by receiving the radio wave from the GPS satellite, after obtaining the date/time information, the standard radio wave is received again even if the elapsed time is within the second reference time and with this, the accurate date/time information can be obtained. Therefore, it is possible to rapidly return to the accurate date/time display.

The present invention is not limited to the above described embodiments and various modifications are possible.

For example, the above described embodiment is described using the GPS satellite as an example. However, the present invention can be applied to data of the positioning satellite which transmits or is to transmit the radio wave in the same format as the GPS satellite.

Moreover, according to the present embodiment, when only the date/time information is obtained and the UTC correction parameter is not obtained, the date/time information is not used. However, the preliminary notice information regarding insert or delete of the leap second starts about a month before the insert or the delete, in other words, at the start of December or June. Therefore, the date/time information obtained in the preliminary notice period, in other words, December or June can be used in correcting and updating the date and time kept by the timekeeping circuit 50, and this can be considered to be receiving OK. In this case, the leap second obtaining flag is to be a cleared state.

According to the present embodiment, when the UTC correction parameter is not obtained, whether the date/time correction is performed is determined based on the GPS date/time data in which the correction of the leap second may not be accurate according to whether the date-time correction is performed recently. However, it is possible to uniformly determine that the date/time correction is not performed.

Moreover, according to the present embodiment, other than receiving the radio wave from the GPS satellite, the date/time information can also be obtained by receiving the standard radio wave, and the transmitting timing of the UTC correction parameter is calculated based on the date/time information obtained by the above method. However, the date and time obtained by other methods of obtaining the date/time information can be used, such as receiving the date/time information from a base station of a cellular phone, or receiving the date/time information by receiving the radio wave from other positioning satellites such as GLONASS satellite.

According to the above embodiment, the UTC correction parameter needs to be received once every half a year. However, when information that the insert or delete of the leap second will not be performed is obtained in advance from the standard radio wave including the information of the leap second, or from other pieces of information, the UTC correction parameter does not have to be received in the respective half of the year.

The present embodiment describes an example using an analog electronic timepiece, however, the electronic timepiece can be a digital display type timepiece. In this case, the display can be controlled to display the time when the leap second is inserted (for example, in Japan, 8:59:60).

The specific details such as the numeric value, configuration, and order of control as described in the present embodiment can be suitably modified without leaving the scope of the present invention.

Although various exemplary embodiments have been shown and described, the invention is not limited to the embodiments shown. Therefore, the scope of the invention is intended to be limited solely by the scope of the claims that follow and its equivalents.

The entire disclosure of Japanese Patent Application No. 2013-268817 filed on Dec. 26, 2013 including specification, claims, drawings and abstract are incorporated herein by reference in its entirety.

What is claimed is:

1. A radio-controlled timepiece comprising:

a timekeeping unit which keeps date and time;

a satellite radio wave receiving unit which receives a transmitting radio wave of a positioning satellite;

a receiving term setting unit which sets a receiving term with the satellite radio wave receiving unit;

a date/time obtaining unit which obtains date/time information from the transmitting radio wave received by the satellite radio wave receiving unit;

an elapsed time counting unit which counts elapsed time from when the date and time is obtained by the date/time obtaining unit; and a first judging unit which judges whether the elapsed time is less than a first reference time determined based on a timekeeping error of the timekeeping unit and a format of a signal transmitted from the positioning satellite, wherein, (i) the receiving term setting unit sets a receiving term corresponding to transmitting timing of a block including correction information regarding a leap second among blocks of a predetermined length including one piece of the date/time information based on the date and time kept by the timekeeping unit when the first judging unit judges that the elapsed time is less than the first reference time; and (ii) the receiving term setting unit sets the receiving term corresponding to the block including the correction information regarding the leap second based on the obtained date/time information or a position of the format of receiving data regarding the obtained date/time information after setting the receiving term corresponding to the transmitting timing of any of the blocks based on the date and time kept by the timekeeping unit and obtaining the date/time information when the first judging unit judges that the elapsed time is not less than the first reference time.

2. The radio-controlled timepiece according to claim 1, further comprising, an external date/time information obtaining unit which obtains date/time information from an external output other than a positioning satellite which transmits a signal in a format including the correction information regarding the leap second, wherein, the elapsed time counting unit counts the elapsed time from a more recent point in time between either when the date/time information is obtained by the date/time obtaining unit or when the date/time information is obtained by the external date/time information obtaining unit.

3. The radio-controlled timepiece according to claim 2, further comprising, a date/time correcting unit which corrects the date and time kept by the timekeeping unit based on the obtained date/time information; and a second judging unit which judges whether the elapsed time is less than a second reference time determined based on the timekeeping error of the timekeeping unit and a length of the leap second, wherein, (i) the date/time correcting unit does not correct the date and time based on the obtained date/time information when the second judging unit judges that the elapsed time is less than the second reference time when the date/time information is obtained by the satellite radio wave receiving unit and the correction information regarding the leap second is not obtained; and (ii) the date/time correcting unit corrects the date and time based on the obtained date/time information when the second judging unit judges that the elapsed time is not less than the second reference time.

4. The radio-controlled timepiece according to claim 3, further comprising, a periodic date/time obtaining unit which attempts to obtain the date/time information in a predetermined interval; and a date/time obtaining history storage unit which stores obtaining success/failure information which is information of success or failure of a recent attempt to obtain the date/time information in a term within the predetermined interval, wherein, (i) the periodic date/time obtaining unit attempts to obtain the date/time information once or a plurality of times within the predetermined interval later on when the obtaining success/failure information shows the attempt to obtain the date/time information failed; and (ii) the obtaining success/failure information is not updated when the second judging unit judges that the elapsed time is less than the second reference time when the date/time information is obtained and the correction information regarding the leap second is not obtained; and (iii) the obtaining success/failure information is updated showing the attempt to receive the date/time information failed when the second judging unit judges that the elapsed time is not less than the second reference time.

5. The radio-controlled timepiece according to claim 1, further comprising, a date/time correcting unit which corrects the date and time kept by the timekeeping unit based on the obtained date/time information; and a second judging unit which judges whether the elapsed time is less than a second reference time determined based on the timekeeping error of the timekeeping unit and a length of the leap second, wherein, (i) the date/time correcting unit does not correct the date and time based on the obtained date/time information when the second judging unit judges that the elapsed time is less than the second reference time when the date/time information is obtained by the satellite radio wave receiving unit and the correction information regarding the leap second is not obtained; and (ii) the date/time correcting unit corrects the date and time based on the obtained date/time information when the second judging unit judges that the elapsed time is not less than the second reference time.

6. The radio-controlled timepiece according to claim 5, further comprising, a periodic date/time obtaining unit which attempts to obtain the date/time information in a predetermined interval; and a date/time obtaining history storage unit which stores obtaining success/failure information which is information of success or failure of a recent attempt to obtain the date/time information in a term within the predetermined interval, wherein, (i) the periodic date/time obtaining unit attempts to obtain the date/time information once or a plurality of times within the predetermined interval later on when the obtaining success/failure information shows the attempt to obtain the date/time information failed; and (ii) the obtaining success/failure information is not updated when the second judging unit judges that the elapsed time is less than the second reference time when the date/time information is obtained and the correction information regarding the leap second is not obtained; and (iii) the obtaining success/failure information is updated showing the attempt to receive the date/time information failed when the second judging unit judges that the elapsed time is not less than the second reference time.

* * * * *